US009758936B2

(12) United States Patent
Wallace

(10) Patent No.: US 9,758,936 B2
(45) Date of Patent: Sep. 12, 2017

(54) POST ASSEMBLY

(71) Applicant: Safe Direction Pty Ltd, Sydney (AU)

(72) Inventor: Hayden Wallace, Sydney (AU)

(73) Assignee: Safe Direction Pty Ltd, Sydney (AU)

( * ) Notice: Subject to any disclaimer, the term of this patent is extended or adjusted under 35 U.S.C. 154(b) by 0 days.

(21) Appl. No.: 15/025,877

(22) PCT Filed: Sep. 8, 2014

(86) PCT No.: PCT/AU2014/050217
§ 371 (c)(1),
(2) Date: Mar. 29, 2016

(87) PCT Pub. No.: WO2015/042656
PCT Pub. Date: Apr. 2, 2015

(65) Prior Publication Data

US 2016/0237633 A1 Aug. 18, 2016

(30) Foreign Application Priority Data

Sep. 30, 2013 (AU) ..... 2013234430

(51) Int. Cl.
*E01F 15/04* (2006.01)
*E01F 15/14* (2006.01)

(52) U.S. Cl.
CPC ..... *E01F 15/0438* (2013.01); *E01F 15/0415* (2013.01); *E01F 15/0461* (2013.01); *E01F 15/0476* (2013.01); *E01F 15/146* (2013.01)

(58) Field of Classification Search
CPC ..... E01F 15/0415; E01F 15/0438; E01F 15/0461; E01F 15/0476; E01F 15/145;
(Continued)

(56) References Cited

U.S. PATENT DOCUMENTS 3,351,322 A * 11/1967 Mueller ..... E01F 15/06 256/13.1
5,657,966 A * 8/1997 Cicinnati ..... E01F 15/0438 256/13.1

(Continued)

FOREIGN PATENT DOCUMENTS

AT EP 1857594 A1 * 11/2007 ..... E01F 15/0476
EP 0677615 A1 10/1995

(Continued)

OTHER PUBLICATIONS

International Search Report and Written Opinion for PCT/AU2014/050217 dated Dec. 15, 2014 (9 pages).

*Primary Examiner* — Josh Skroupa
*Assistant Examiner* — Cory B Siegert
(74) *Attorney, Agent, or Firm* — John W. Branch; Lowe Graham Jones PLLC

(57) ABSTRACT

A post assembly for absorbing impact from a vehicle including a footing, an upright post and a hinge region to allow the post to plastically deform relative to the footing. The post is preferably fixed to a lever arm that is connected to the footing via the hinge region, the lever arm and post pivoting away from the footing under load, The lever arm, footing and hinge region are preferably formed from a common base plate. The invention also relates to barrier system that includes multiple post assemblies, and a barrier supported between respective posts of the assemblies.

13 Claims, 30 Drawing Sheets

(58) Field of Classification Search
CPC ..... E01F 15/146; E01F 15/148; E01F 9/631; E01F 9/635; E04F 11/1812; E04H 17/08; E04H 17/22; E04B 1/2608; E04B 1/2612; E04B 2001/2684
USPC ..... 256/13.1, 64; 248/548, 900, 909; 52/698, 702
See application file for complete search history.

(56) References Cited

U.S. PATENT DOCUMENTS

| | | | | |
|---|---|---|---|---|
| 5,664,905 | A * | 9/1997 | Thompson | E01D 19/103 248/548 |
| 8,235,359 | B2 * | 8/2012 | Dyke | E01F 15/146 256/13.1 |
| 2004/0262588 | A1 * | 12/2004 | Bronstad | E01F 15/146 256/13.1 |
| 2010/0293870 | A1 * | 11/2010 | Amengual Pericas | E01F 15/0476 52/98 |

FOREIGN PATENT DOCUMENTS

| | | | |
|---|---|---|---|
| EP | 1650351 | A2 | 4/2006 |
| EP | 1857594 | A1 | 11/2007 |

* cited by examiner

POST ASSEMBLY

RELATED APPLICATION

The present application is a U.S. National Phase Application of International Patent Application No. PCT/AU2014/050217, filed on Sep. 8, 2014, which claims priority from Australian Patent Application No. 2013234430, filed on Sep. 30, 2013, the contents of which are incorporated in entirety by reference.

FIELD OF THE INVENTION

The present invention relates to a post assembly for a barrier system particularly but not exclusively a car park guardrail system.

BACKGROUND OF THE INVENTION

Traditional base plated posts used in a guardrail system are manufactured from relatively strong rigid materials such as steel. Despite the posts being relatively strong in their own right the strength of the system is typically relatively weak as its capacity is limited by the pullout resistance of anchor bolts that secure the base plated posts to the underlying ground/concrete slab. Rigid post systems absorb the full force of the impact with little deflection resulting in a high peak load being transferred to the anchor bolts.

To maximize load carrying capacity, a rigid post system would require a base plate with a large footprint effectively enabling the anchor bolts to be positioned as far as possible from the base of the post on the impact side of the post. The further the bolts are distanced from the base of the post the lower the pullout force experienced by the anchor bolts during collision with the system.

However, larger plates may be difficult to accommodate in a car park environment. Moreover, despite a design that may position the anchor bolts at a reasonable distance from the bottom of the post, rigid post systems typically require numerous anchor bolts in order to have sufficient capacity to resist the impacting vehicle on the system.

The material costs of large base plates can be prohibitive and holes drilled for multiple fastening bolts may compromise the structural integrity of an underlying concrete slab, which could be of particular concern if the slab forms an elevated floor in a multi-level car park.

OBJECT OF THE INVENTION

The present invention seeks to provide an alternative post assembly.

SUMMARY OF THE INVENTION

In accordance with the invention, there is provided a post assembly for absorbing impact from a vehicle including a post, a footing and a lever arm connecting the post to the footing at a hinge region, wherein: the footing, lever arm and hinge region are formed from a common base plate, with the footing and lever arm being separated by an elongate slot that extends in a direction away from an impact side of the plate and terminates at the hinge region, located toward a rear side of the plate; and the footing includes at least one aperture located toward the impact side of the plate, to receive a corresponding fastener to anchor the post assembly to a support surface; whereby under an impact load, the hinge region plastically deforms and the lever arm and post deflect about the footing, away from the impact side of the plate.

Preferably, the at least one aperture is located remote from the hinge region to reduce pullout forces on the associated fastener when the post pivots relative to the footing.

Preferably, the footing and lever arm are formed from a common plate to be substantially co-planar.

Preferably, the lever arm extends parallel to and adjacent the footing.

Preferably, the post includes a side member attached to and aligned with lever arm.

Preferably, the post includes two opposed side members connected to the lever arm.

Preferably, the footing includes two base pads positioned either side of the lever arm, the base pads being separated from the lever arm by associated slots.

Preferably, a second lever arm is provided on an opposite side of the footing, the second lever arm being separated from the footing by an associated slot and the post includes a second side member attached to the second lever arm.

Preferably, the footing includes a single base pad positioned between the lever arms.

Preferably, the post assembly includes a stop device to restrict deflection of the post beyond a pre-determined position.

Preferably, the stop device includes a notch in the post that closes as the post pivots under plastic deformation of the hinge region.

Preferably, the notch is formed at a base of the post, to provide clearance between the post and the hinge region, so that the lever arm is free to pivot around the hinge region during deflection of the post away from the footing, until the notch closes against the hinge region.

Preferably, the post is adapted to support a rail element in a position forwardly of the hinge region, with respect to a direction of impact of a vehicle or the like whereby pivotal movement of the post about the footing during impact causes the rail element to be lifted or maintained in height in order to contain and arrest movement of the vehicle.

In another aspect, there is provided a barrier system including multiple post assemblies, as described above, and a rail element supported between respective posts of the assemblies.

Preferably, the rail element is mounted to the posts in a position forwardly of the associated hinge region, with respect to a direction of impact of a vehicle, whereby pivotal movement of the posts about the footing during impact causes the rail element to be lifted or maintained in height in order to contain the vehicle.

BRIEF DESCRIPTION OF THE DRAWINGS

The invention is described, by way of non-limiting example only, with reference to the drawings, in which.

DETAILED DESCRIPTION OF THE INVENTION

Figure 1:
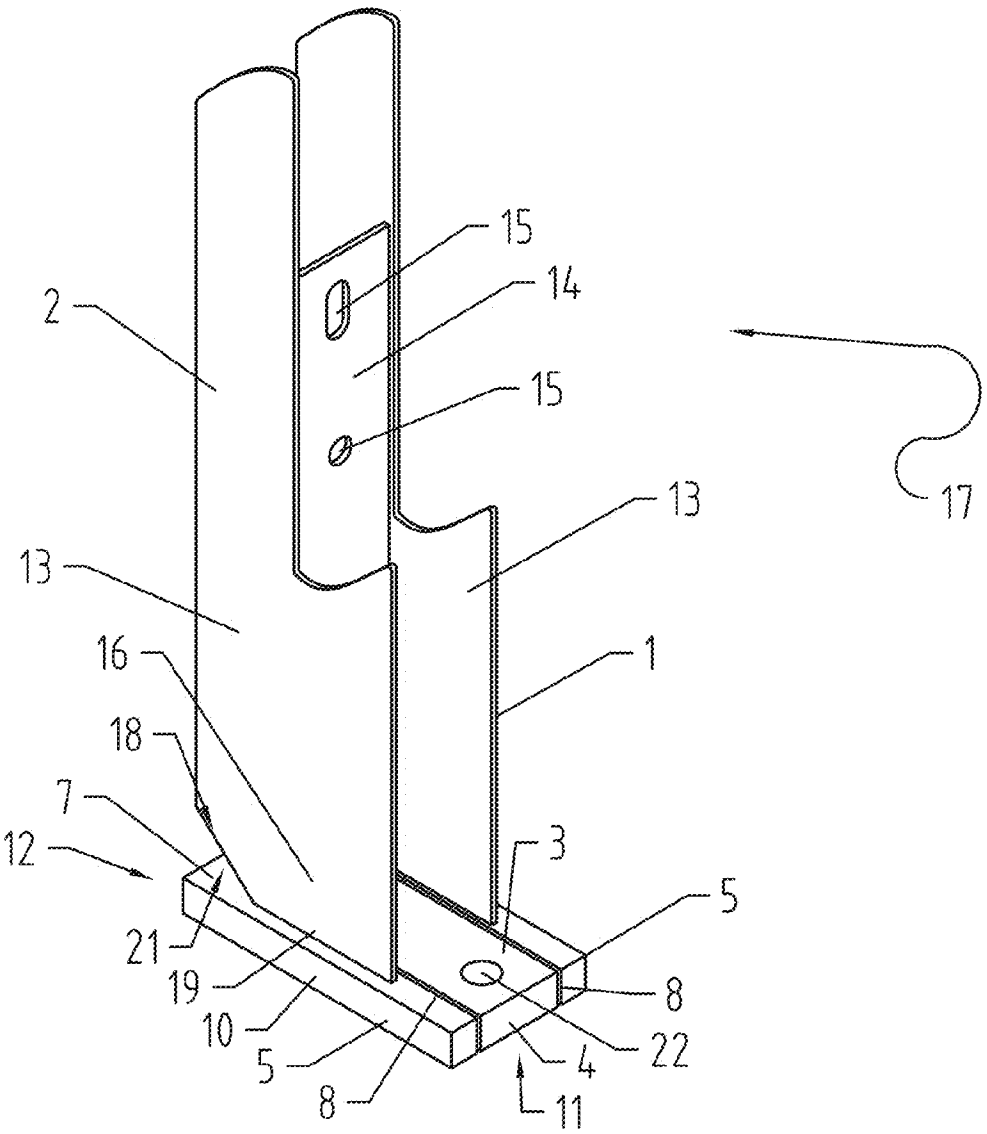
FIG. 1 is a perspective view of post assembly.

Throughout the specification and drawings, like parts will be denoted with like reference numerals.

Referring firstly to FIG. 1, a post assembly 1 includes a post 2 and a footing 3.

The footing 3 includes a base pad 4 connected to first and second lever arms 5 via a hinge region 7. The lever arms 5 are positioned on opposed sides of the base pad 4 and are separated from the base pad 4 by elongate slots 8 in order to be free to pivot about the hinge region 7.

The lever arms 5 and the footing 3 are formed as a single base plate 10, so that the lever arms 5 and footing 3 are substantially co-planar. The slots 8 are preferably machined into the plate 10 to extend from a front side 11 of the plate 10, toward a rear side 12 of the plate 10. However, the slots 8 terminate short of the rear side 12 in order to define the hinge region 7 that connects the base pad 4 and lever arms 5, 6.

The post 2 is formed of two opposed side members 13 arranged in a parallel front to back orientation. A connecting brace 14 extends between the side members 13. Fastener holes 15 are provided in the brace 14. A lower end 16 of each side member 13 is attached to a respective lever arm 5, such as by welding, so that the entire assembly 1 is formed as an integral structure.

The post assembly 1 is designed to receive and absorb forces from an impact side 17 of the post 2, which will cause the post 2 to deflect about the footing 3. More particularly, the post 2 will lift and pivot the lever arms 5 about the hinge region 7, as impact force is absorbed. To restrict pivotal movement of the post 2, a notch 18 is provided at the base 19 of the post 2, at the lower end 16 of each side member 13. The notch 18 is positioned immediately above the hinge region 7 and serves as a stop device 21 to resist pivotal movement of the post 2 past a pre-determined position, by closing against the hinge region 7 when the post 2 pivots about the footing 3.

Plastic deformation of the post 2 away from the footing 3 will absorb a considerable amount of impact force. However, the footing 3 still needs to be securely fastened to an underlying support surface in a manner that will minimize pullout forces. For that purpose, the base pad 4 is provided with an aperture 22 that is positioned remote from the hinge region 7, at a location toward the front side 11 of the plate 10. In use, the aperture 22 receives a fastener or anchor bolt (not shown) to anchor the post assembly 1 to the support surface.

FIG. 2 shows additional views of the post assembly 1. FIG. 2*a* clearly illustrates the elongate slots 8 extending in a linear manner from a front side 11 of the plate 10 toward a rear side 12. Terminal ends 25 of the slots 8 are a distance "d" from the rear side 12. Different impact absorbing properties may be obtained by varying the distance "d".

Figure 2A:
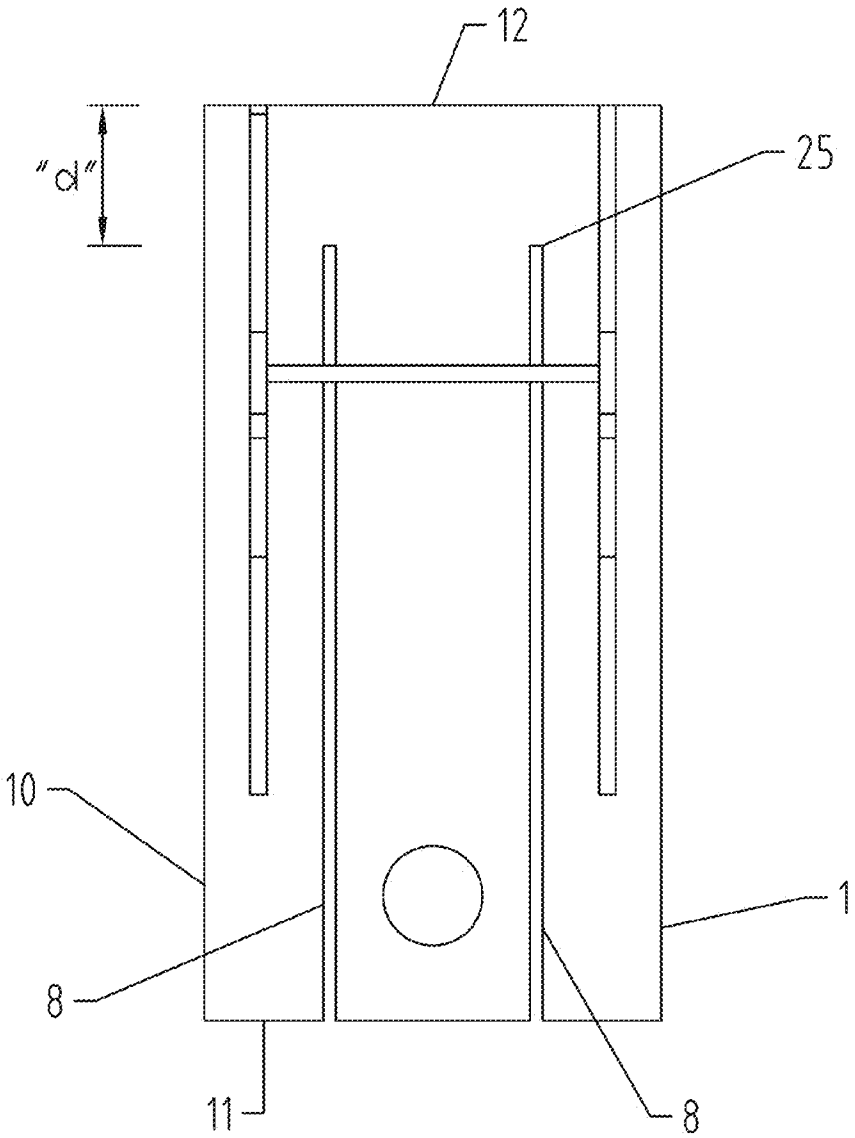
FIG. 2A-D illustrates top, front and side views another post assembly.
Figure 2B:
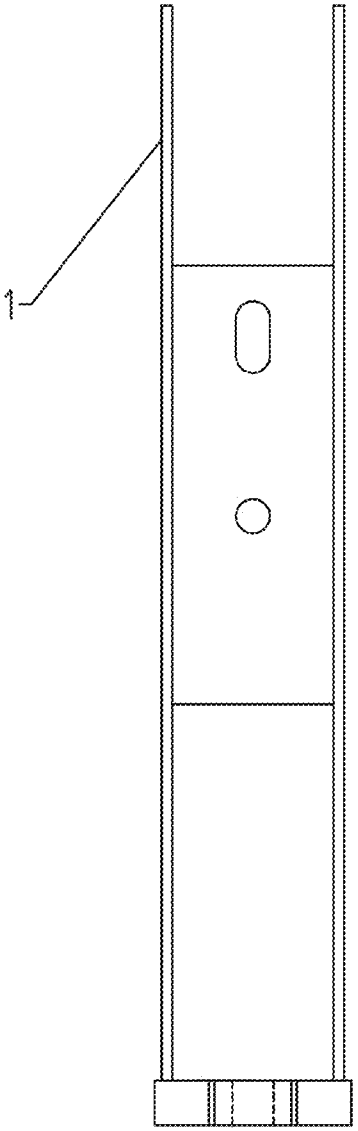
Figure 2C:
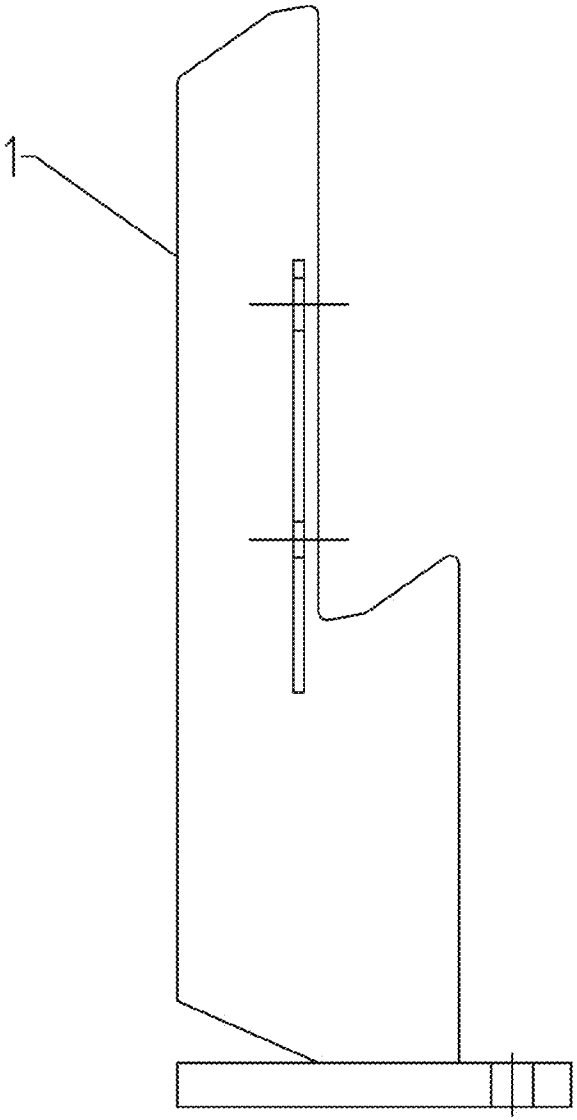
Figure 2D:
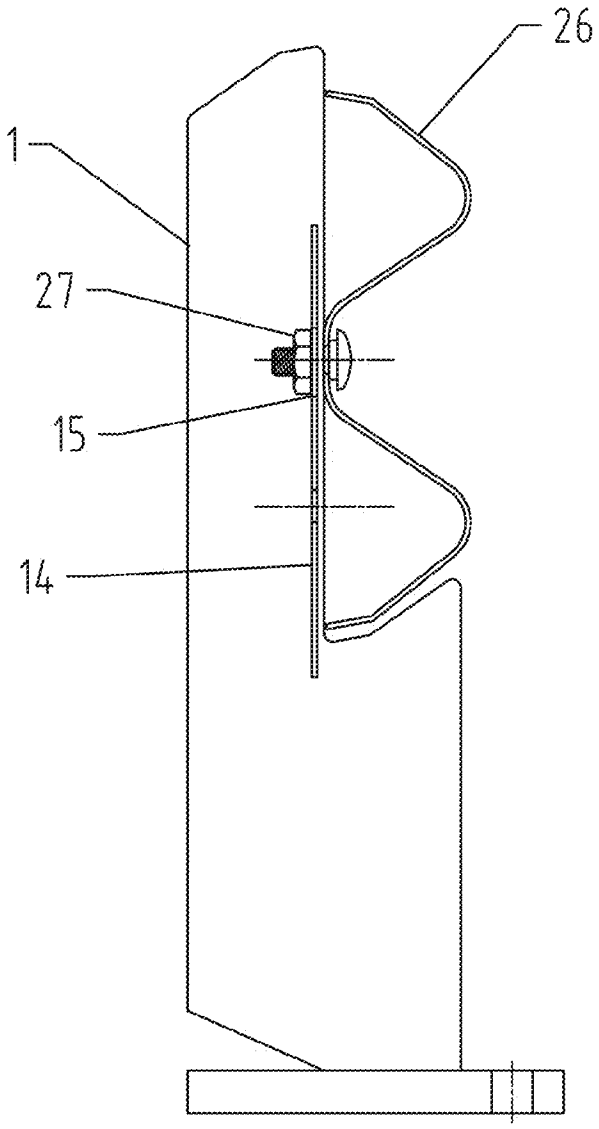
Figure 3A:
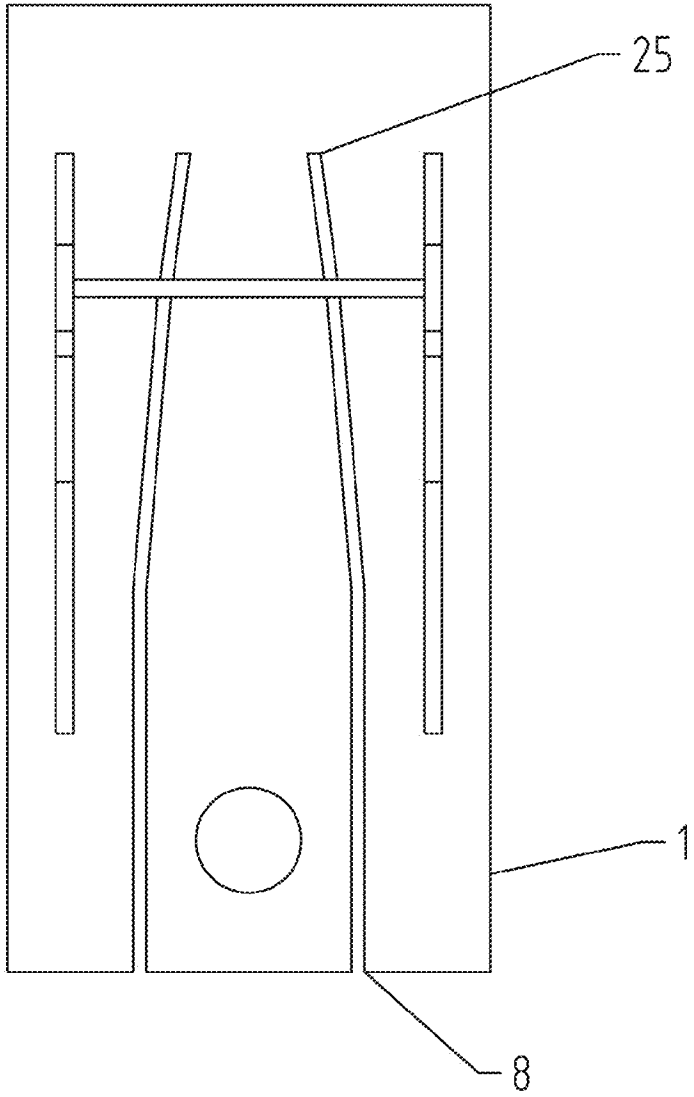
FIG. 3A-D illustrates top, front and side views of yet another post assembly.
Figure 3B:
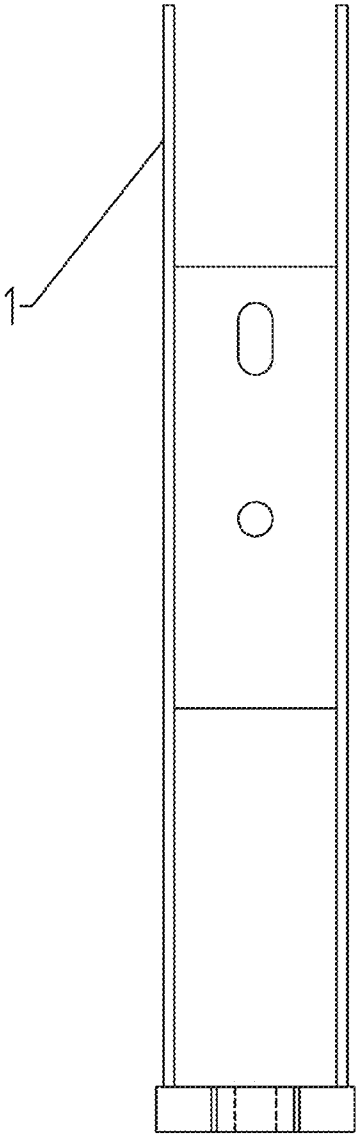
Figure 3C:
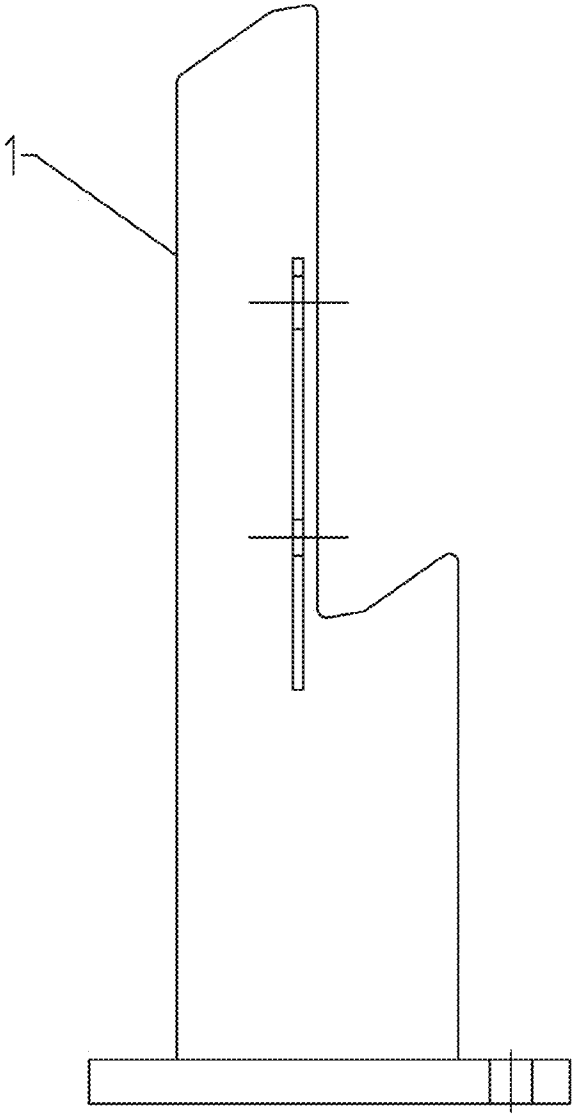
Figure 3D:
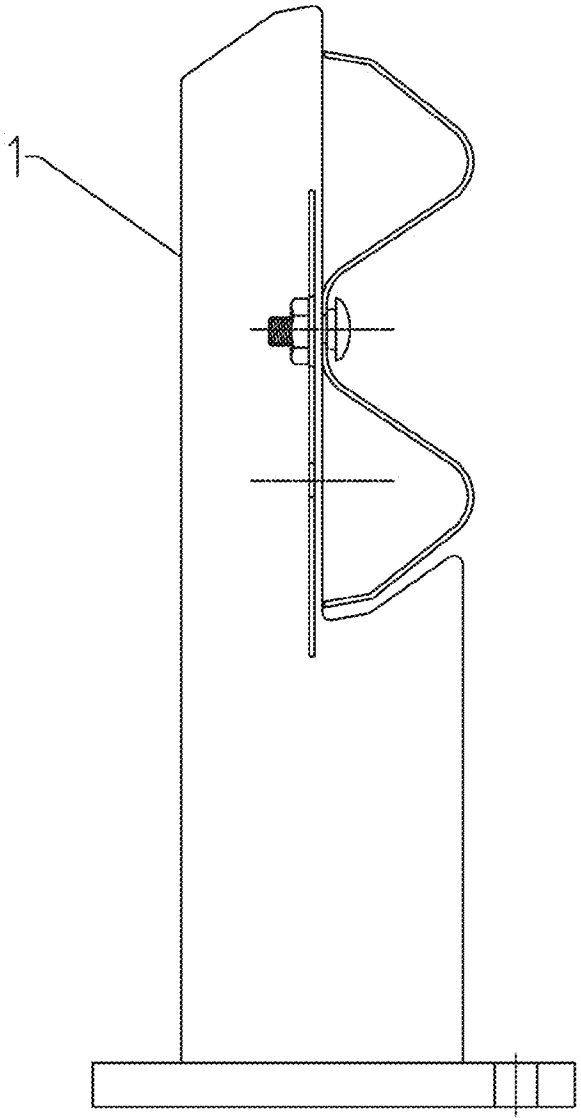
Figure 4A:
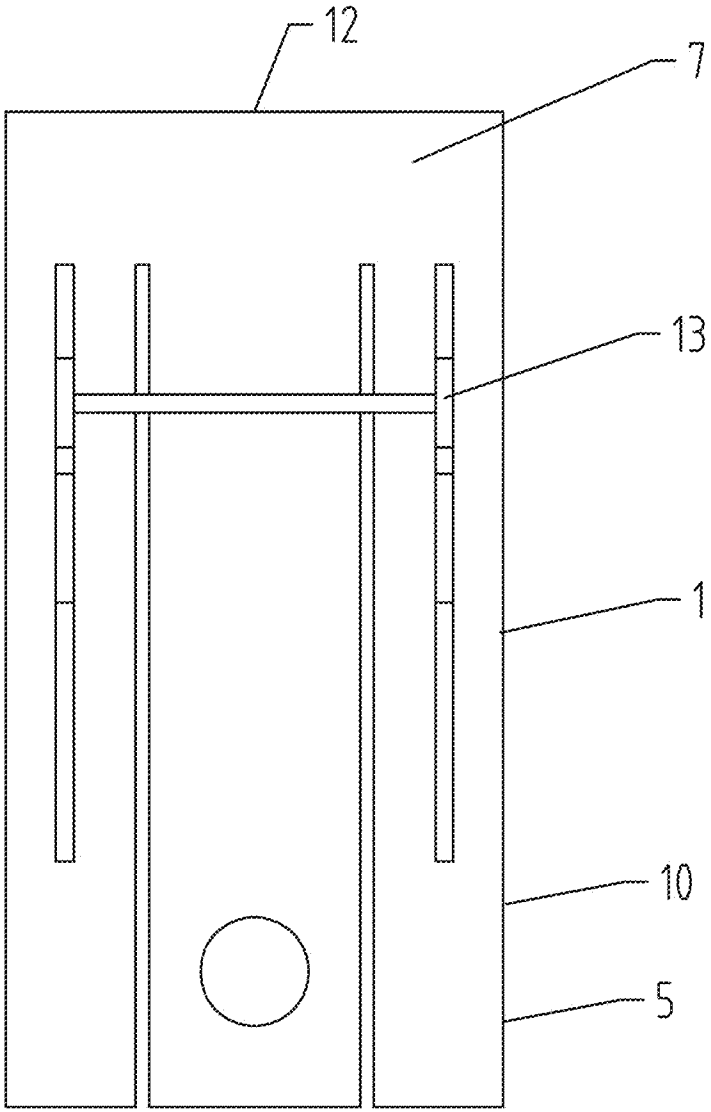
FIG. 4A-D illustrates top, front and side views of a further post assembly.
Figure 4B:
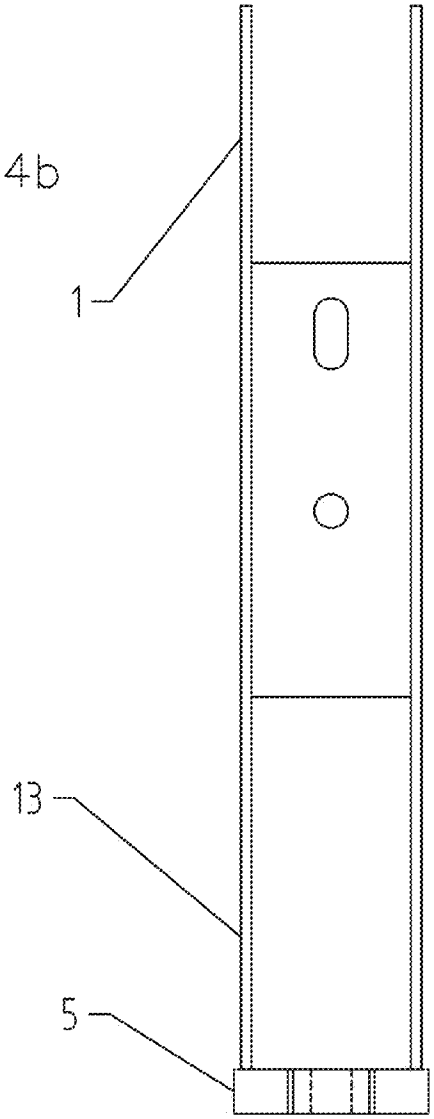
Figure 4C:
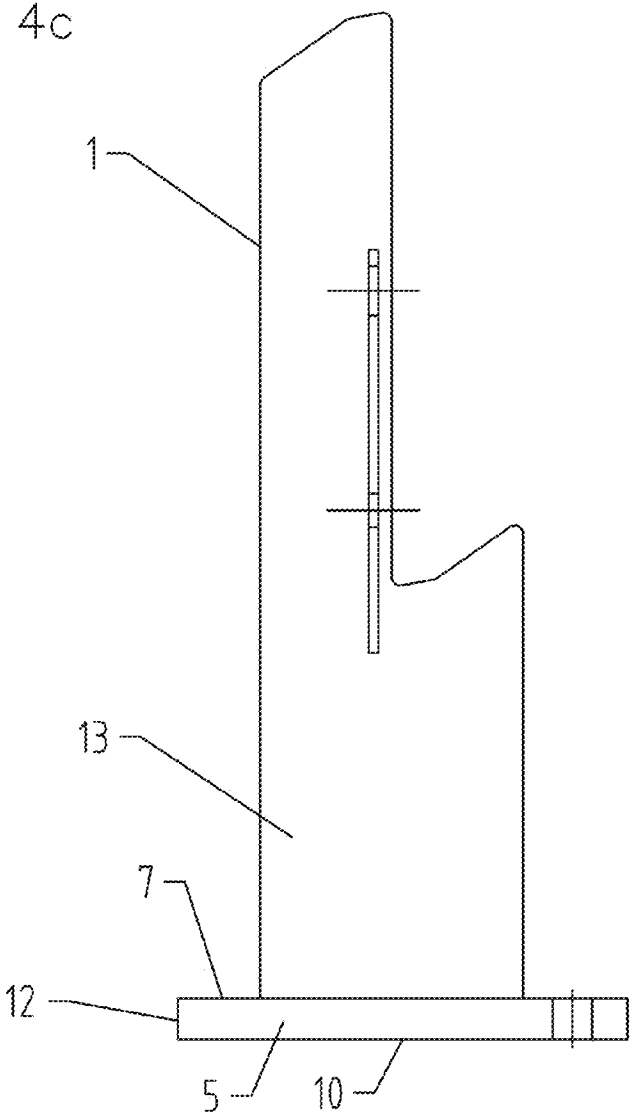
Figure 4D:
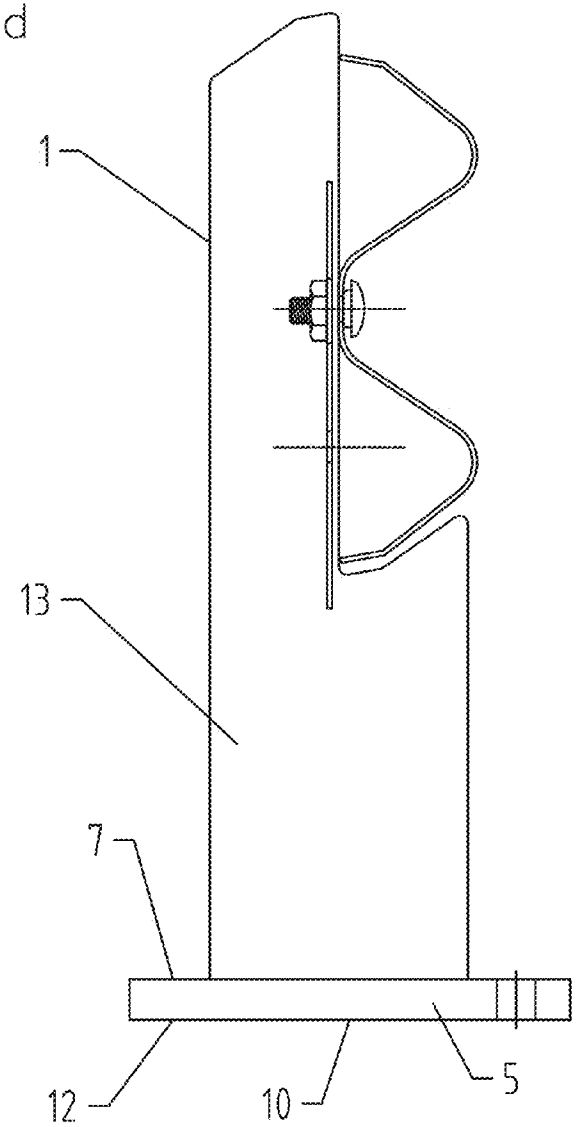
Figure 5A:
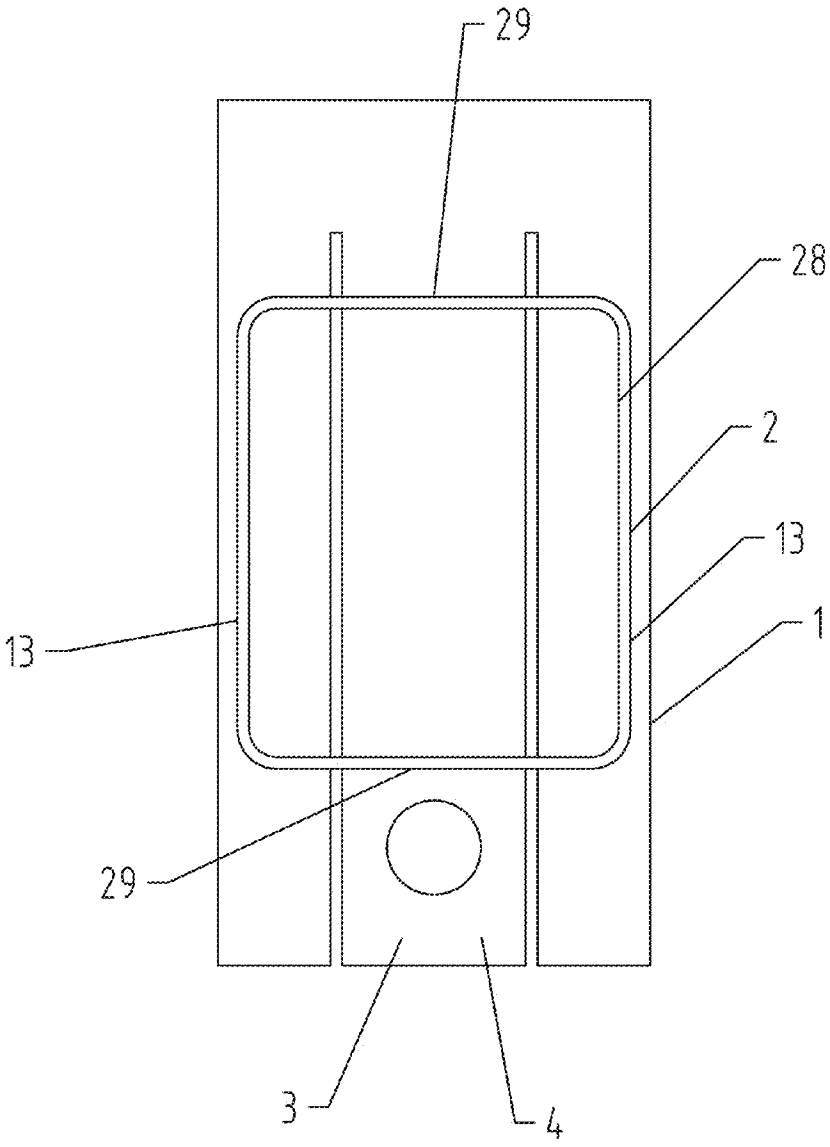
FIG. 5A-D illustrates top, front and side views of another post assembly.
Figure 5B:
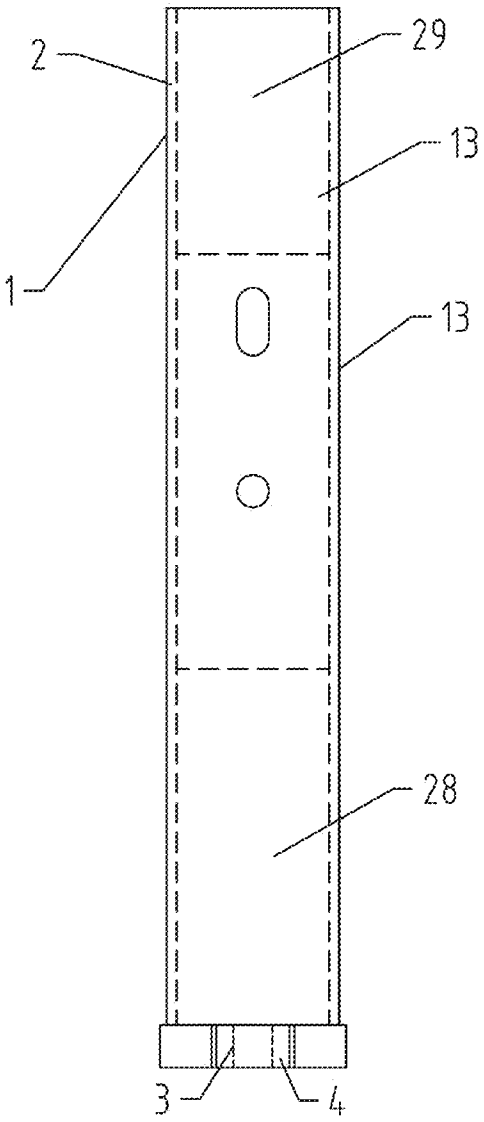
Figure 5C:
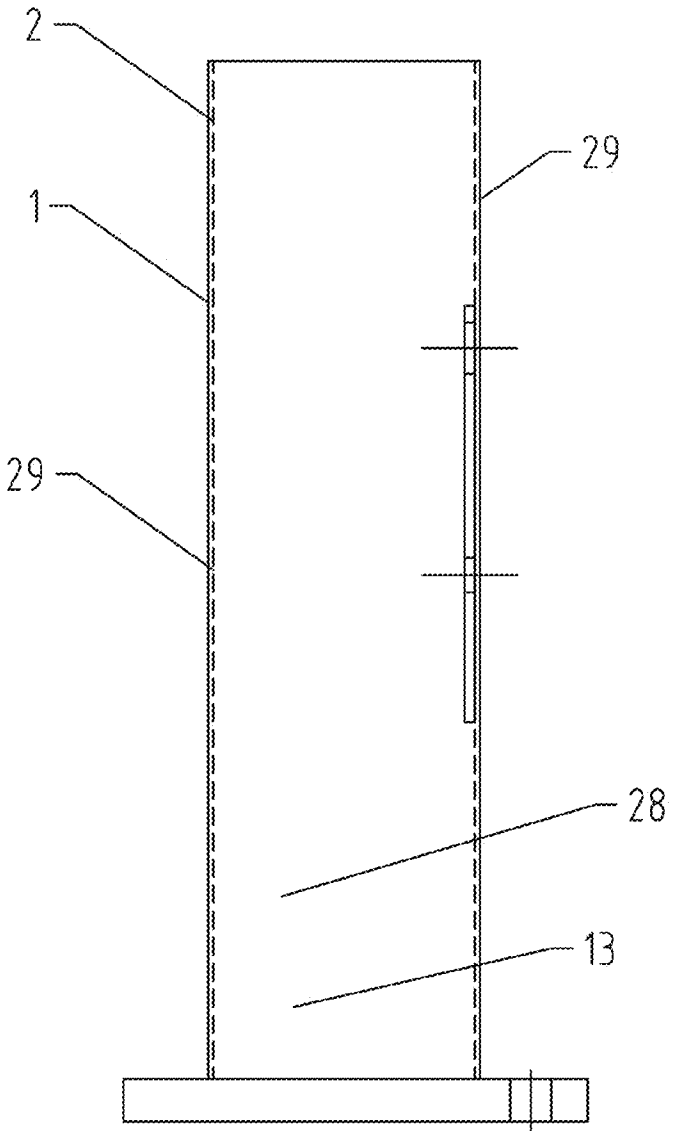
Figure 5D:
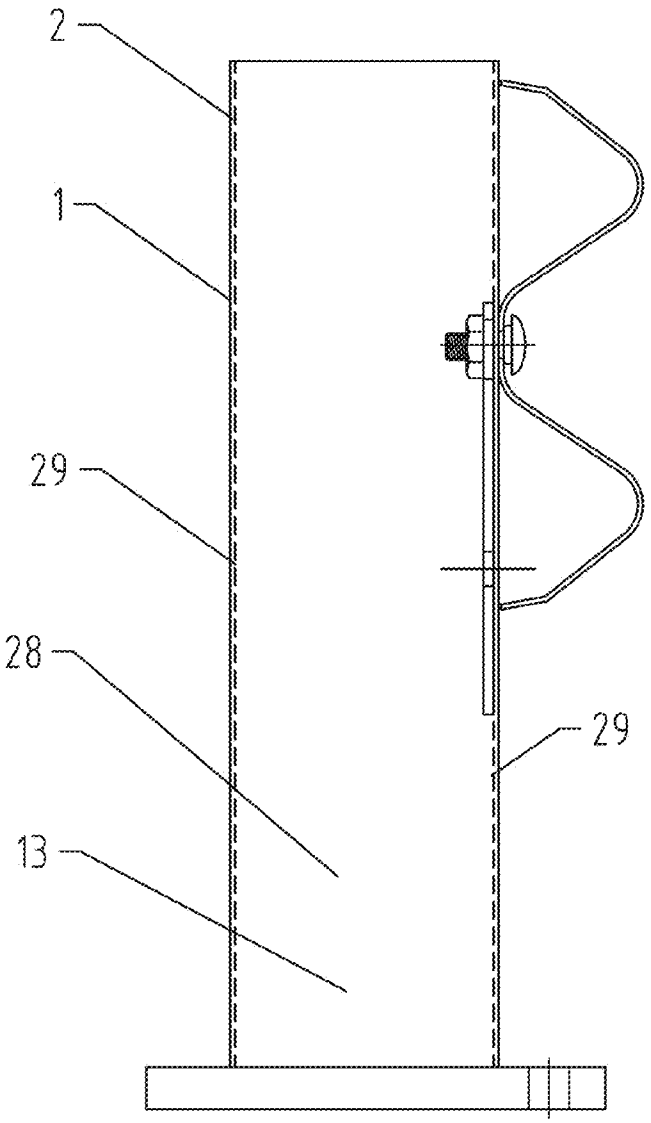
Figure 6A:
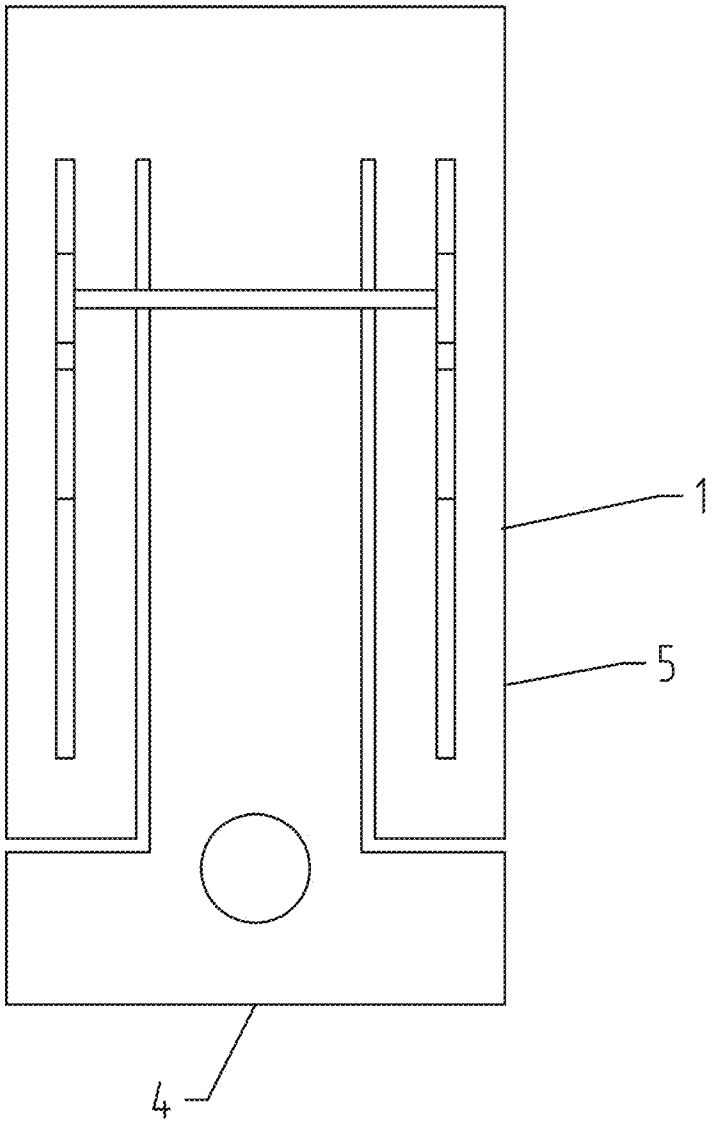
FIG. 6A-D illustrates top, front and side views of yet another post assembly.
Figure 6B:
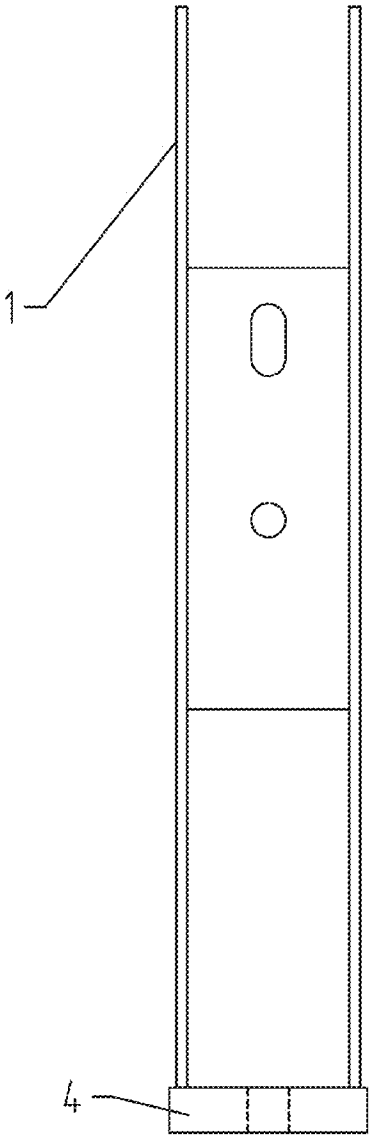
Figure 6C:
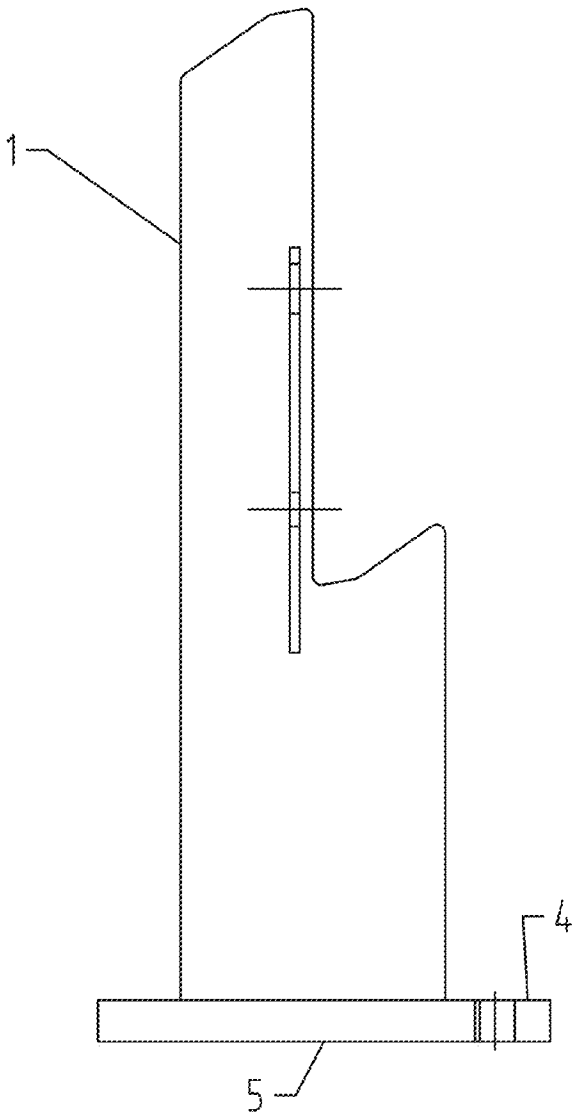
Figure 6D:
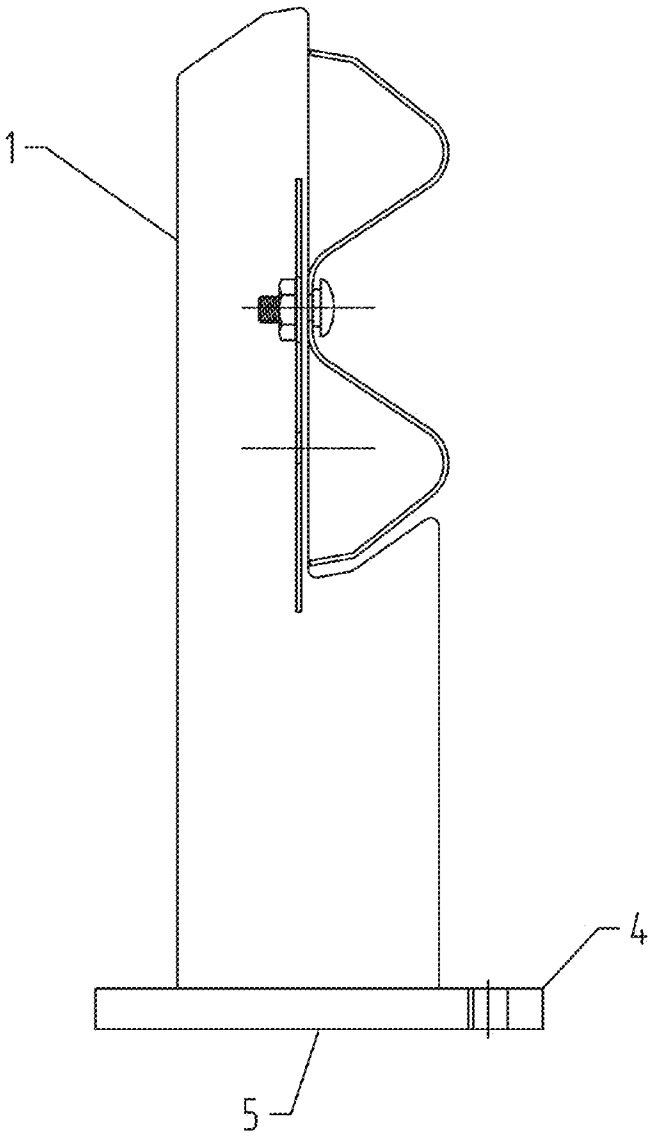

FIG. 2*d* shows a W-beam guardrail 26 secured to the post 2 via a fastener 27, which is received through the top hole 15 in the brace 14.

FIG. 3 shows similar views of another post assembly 1. In this case, the elongate slots 8 are angled toward each other, in a direction toward the terminal ends 25 to modify the energy absorbing properties of the post assembly 1.

FIG. 4 shows another post assembly 1, similar to that of FIG. 2, except without the notches 18. In order for the side members 13 not to obstruct the bending action of the hinge region 7, the rear side 12 of the base plate 10 is extended so that the hinge region 7 is clear of the connection of the side members 13 to the lever arms 5.

FIG. 5 shows another post assembly 1, similar to that of FIG. 4, except in this case, the post 2 is formed of a hollow section 28 with side members 13 and front and back sides 29. Obviously, the front and back sides 29 of the post 2 are not directly fixed to the base pad 4 otherwise the post 2 would be prevented from pivoting relative to the footing 3.

FIG. 6 illustrates yet another post assembly 1, where the lever arms 5 are shortened and the base pad 4 is T-shaped. It should be appreciated that the shape or dimensions of any of the component parts of the post assembly 1 can be modified, as required, in order to change the energy absorbing characteristics of the post assembly 1.

Figure 7:
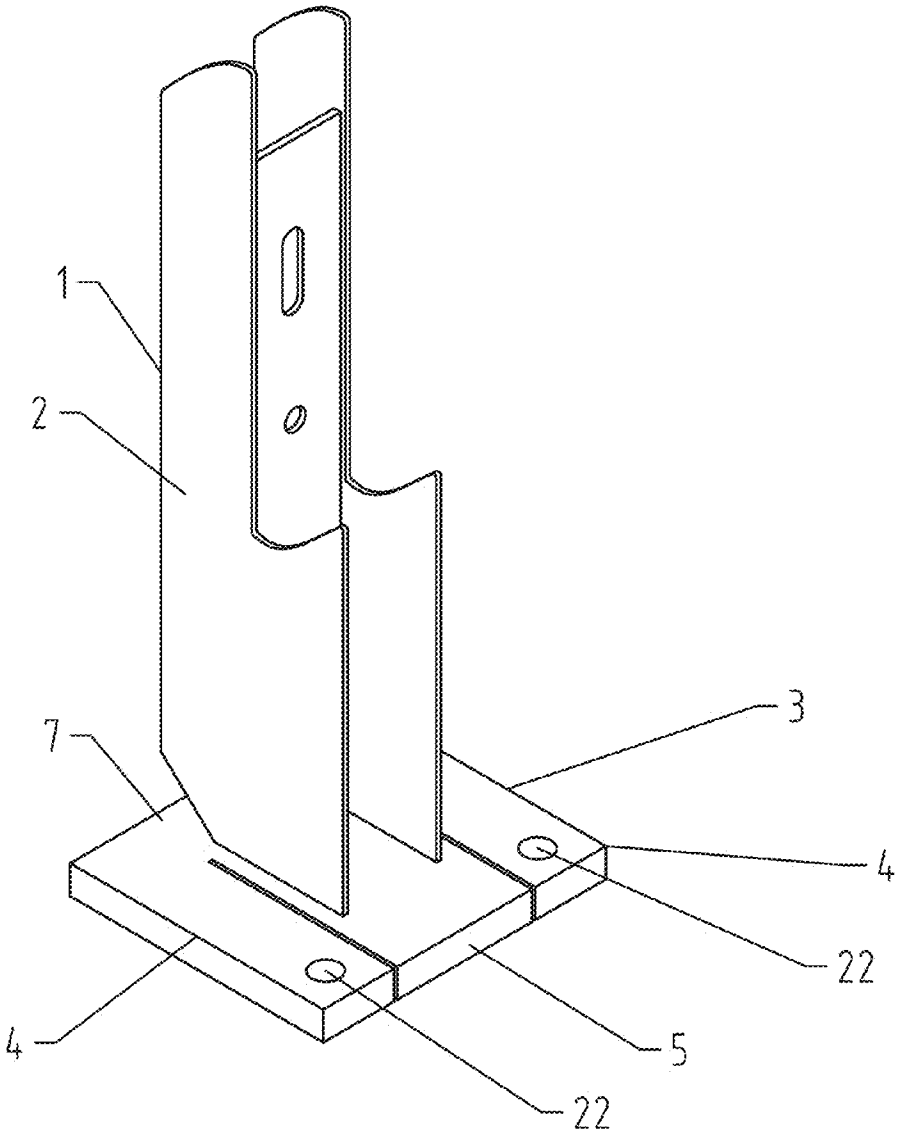
FIG. 7 is a perspective view of another post assembly.

FIG. 7, for example, illustrates another post assembly 1, where the post 2 is connected to a single lever arm 5 that is nested inside the footing 3. In this example, the footing 3 is formed of two base pads 4 either side of the lever arm 5. Each base pad 4 is provided with a fastener aperture 22 remote from the hinge region 7 to accommodate anchor bolts or the like. The post assembly 1 is intended for heavy duty environments, where substantial hold down requirements need to be satisfied.

Figure 8:
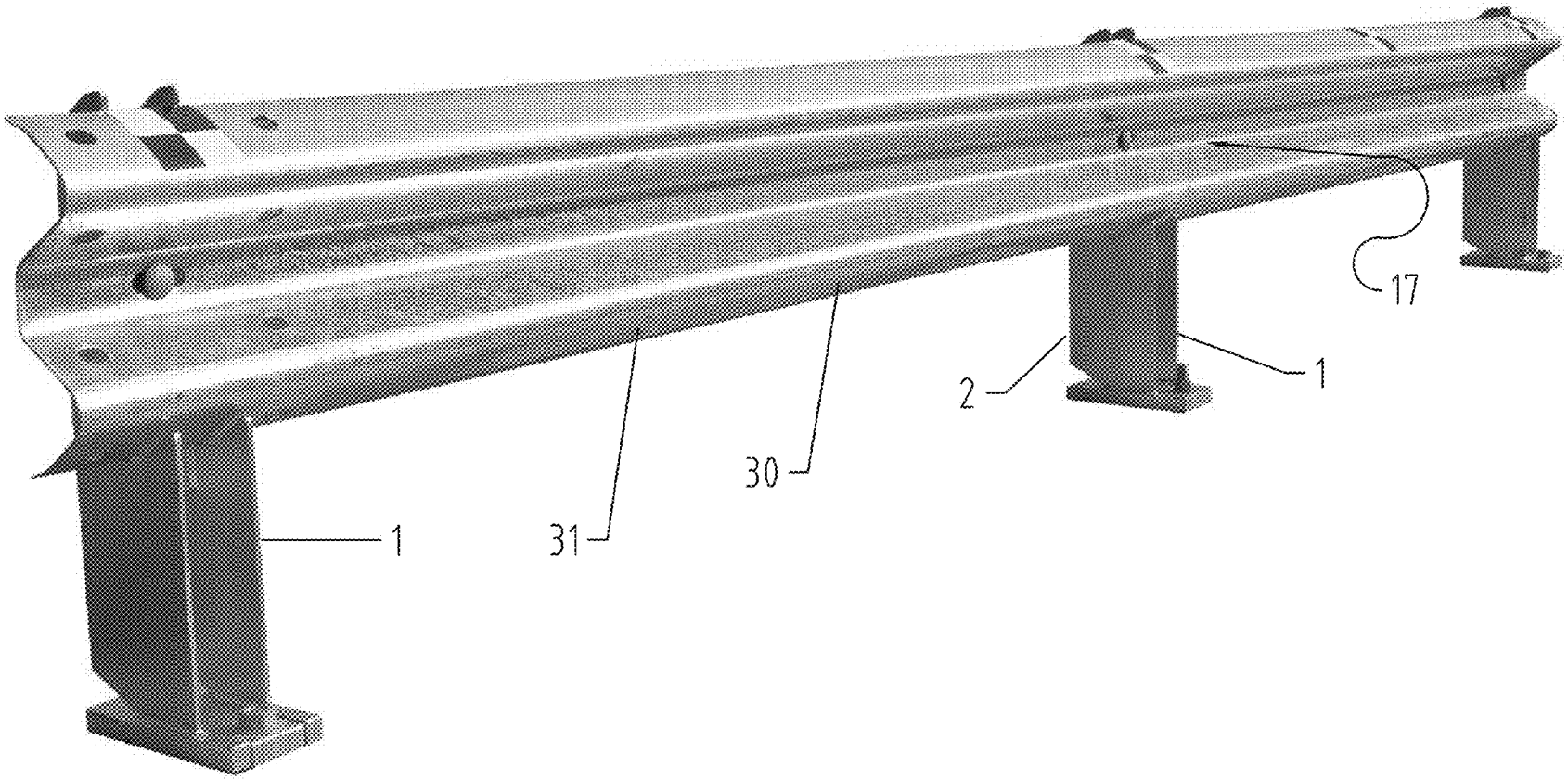
FIG. 8 is an image showing a perspective view of a barrier system.
Figure 9:
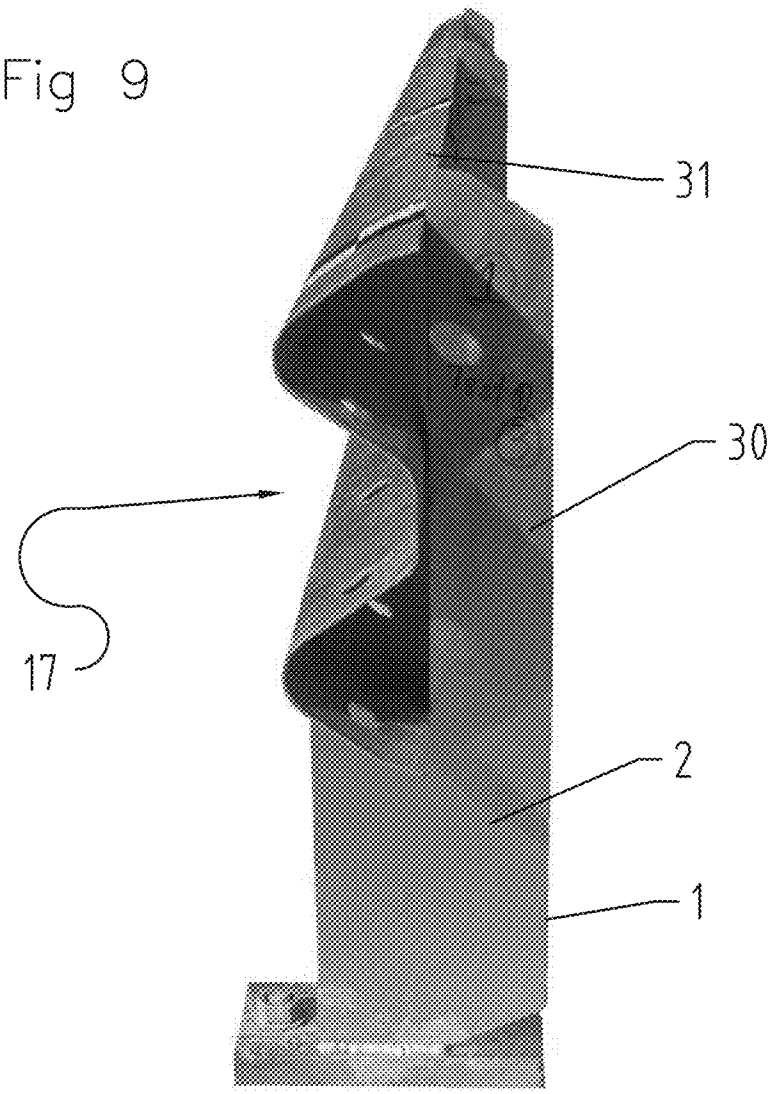
FIG. 9 is an image showing a side view of the barrier system.

Turning now to FIGS. 8 and 9, a barrier system 30 is shown in which a plurality of post assemblies 1 are positioned to hold a rail element 31. In an alternative embodiment, the post assemblies may support multiple rail elements, if required. The rail element 31 is held on an impact side 17 of the posts 2. The bather system 30 may be for use in a car park or any other location where vehicles or the like need to be contained. By way of other examples, the barrier system 30 may have application as a warehouse barrier or bridge barrier to safely contain errant vehicles.

Figure 10:
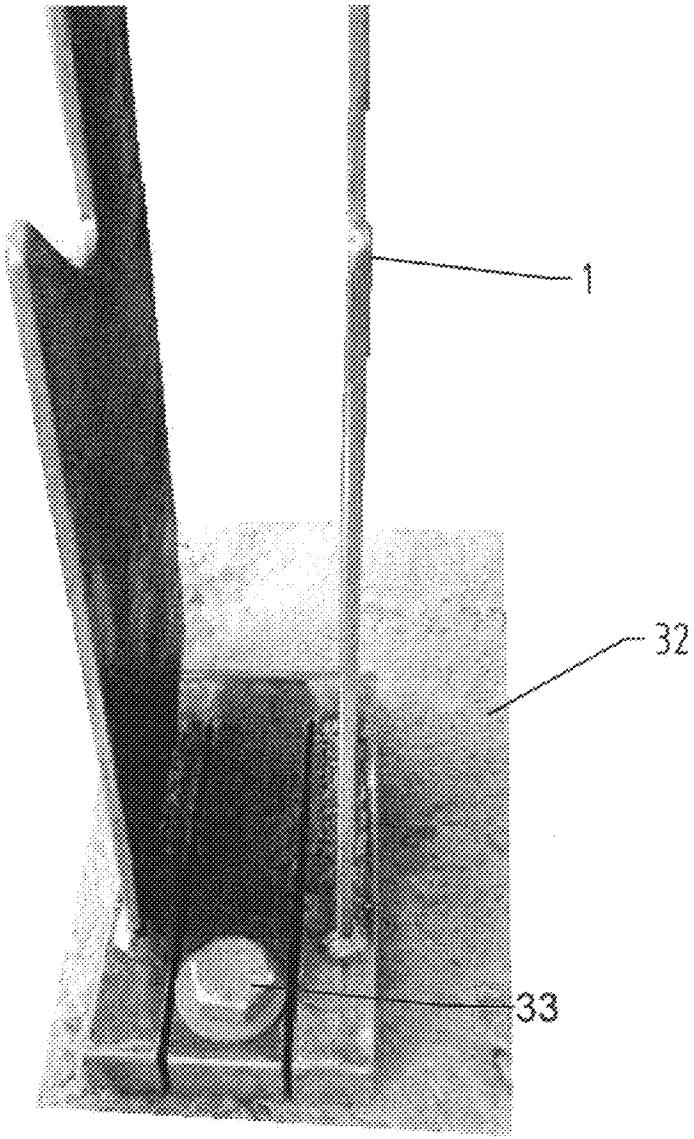
FIG. 10 is a perspective view of a footing of a post assembly of the barrier system.

FIG. 10 shows one of the post assemblies 1 fixed to a support surface 32 with a fastening bolt 33, prior to an impact. It should be noted that the post assembly is described here as being part of a barrier system but can equally be used as an independent bollard, if needed.

Figure 11:
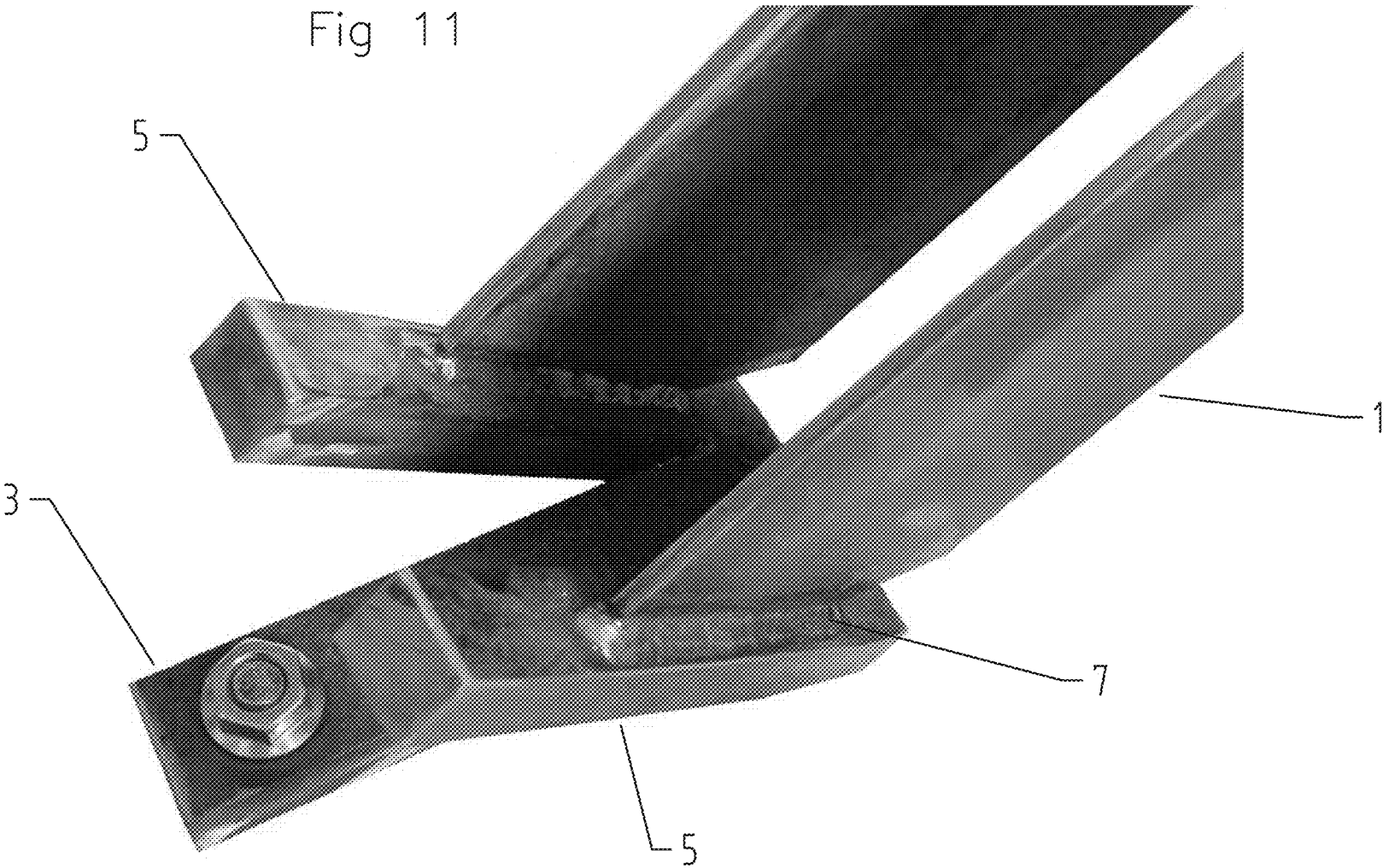
FIG. 11 is a perspective view of the footing with the post deformed about a hinge region.

FIG. 11 illustrates the post assembly after impact, where the lever arms 5 have lifted away from the footing 3 and pivoted about the hinge region 7.

Figure 12:
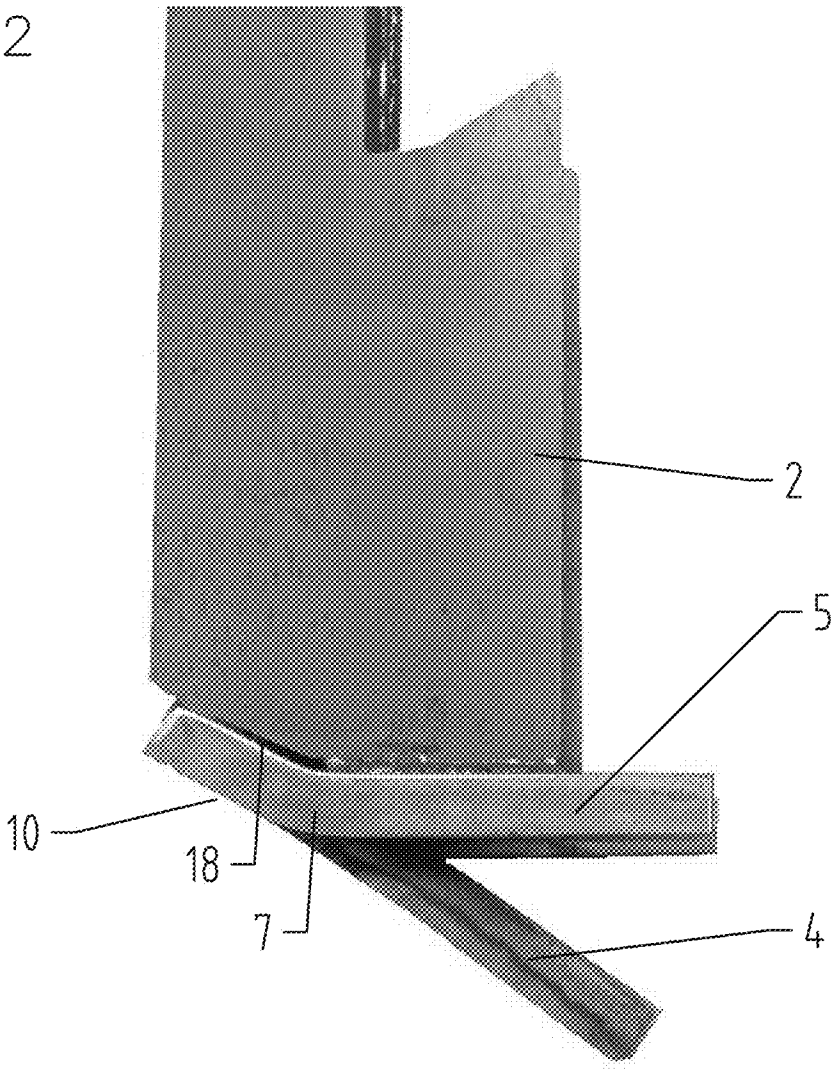
FIG. 12 is a side view of the footing and base of the post of FIG. 11.

FIG. 12 is a side view showing the position of the post 2 and lever arms 5 relative to the base pad 4, after impact, where the notch 18 has closed against the hinge region 7 of the base plate 10, to resist further pivoting movement of the post 2.

Figure 13:
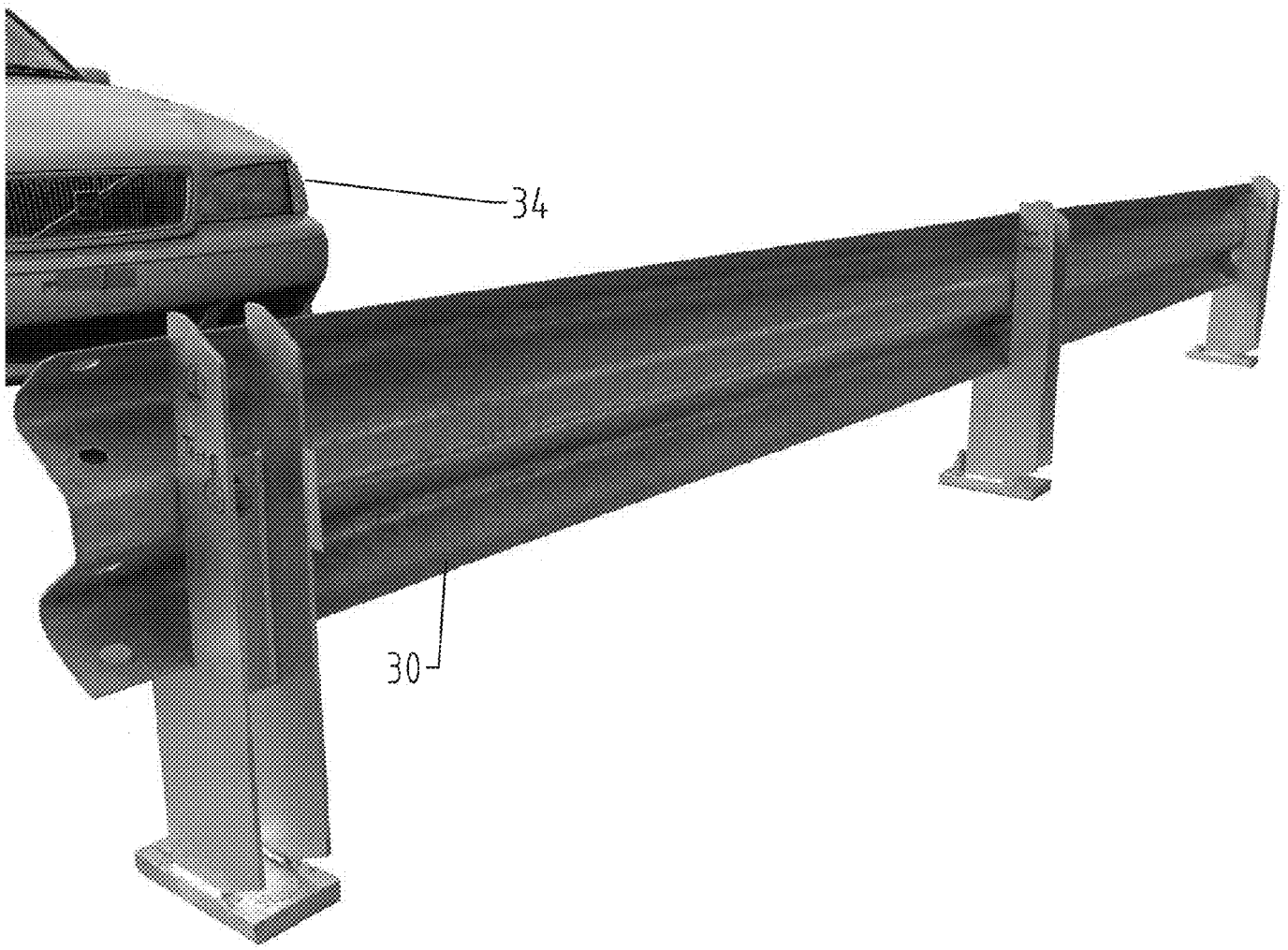
FIG. 13 is an image showing a perspective view from a reverse side of the barrier system.

FIG. 13 shows a vehicle 34 approaching the bather system 30, prior to collision.

Figure 14:
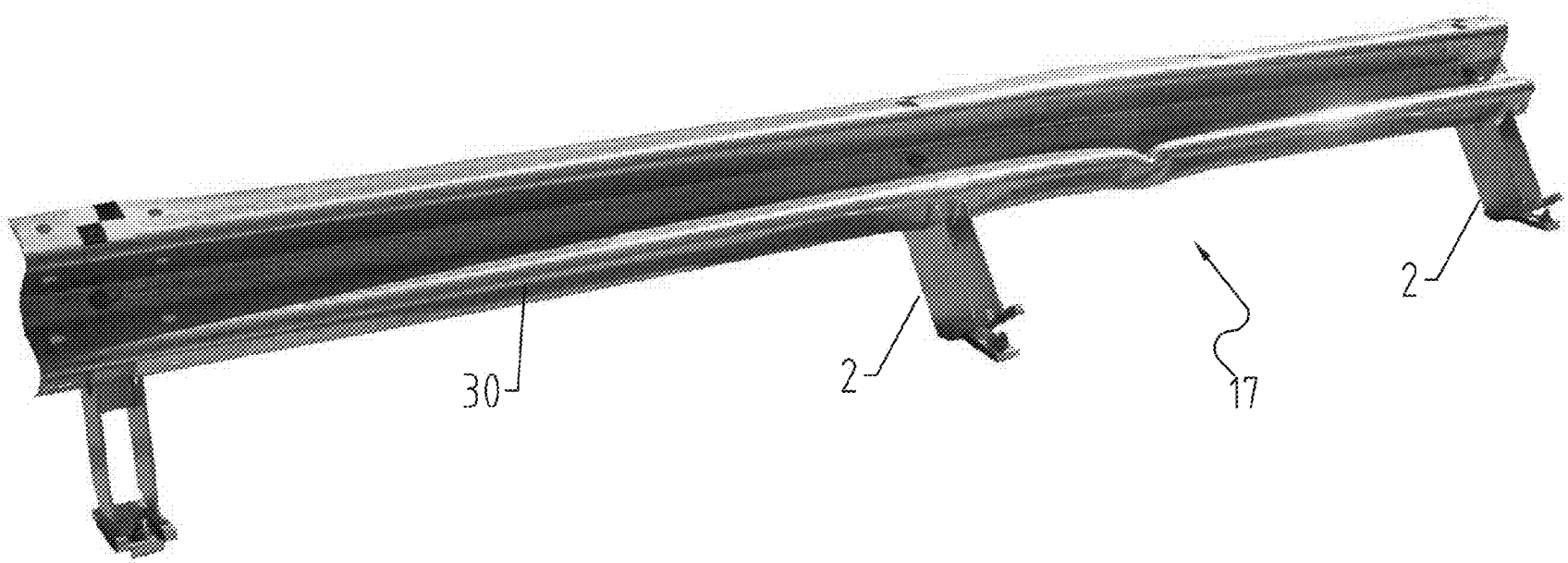
FIG. 14 is an image showing a perspective view of the barrier system after an impact.

FIG. 14 shows the result of impact on the barrier system 30. In particular, the posts 2 have deflected away from the impact side 17 to absorb the collision.

Figure 15:
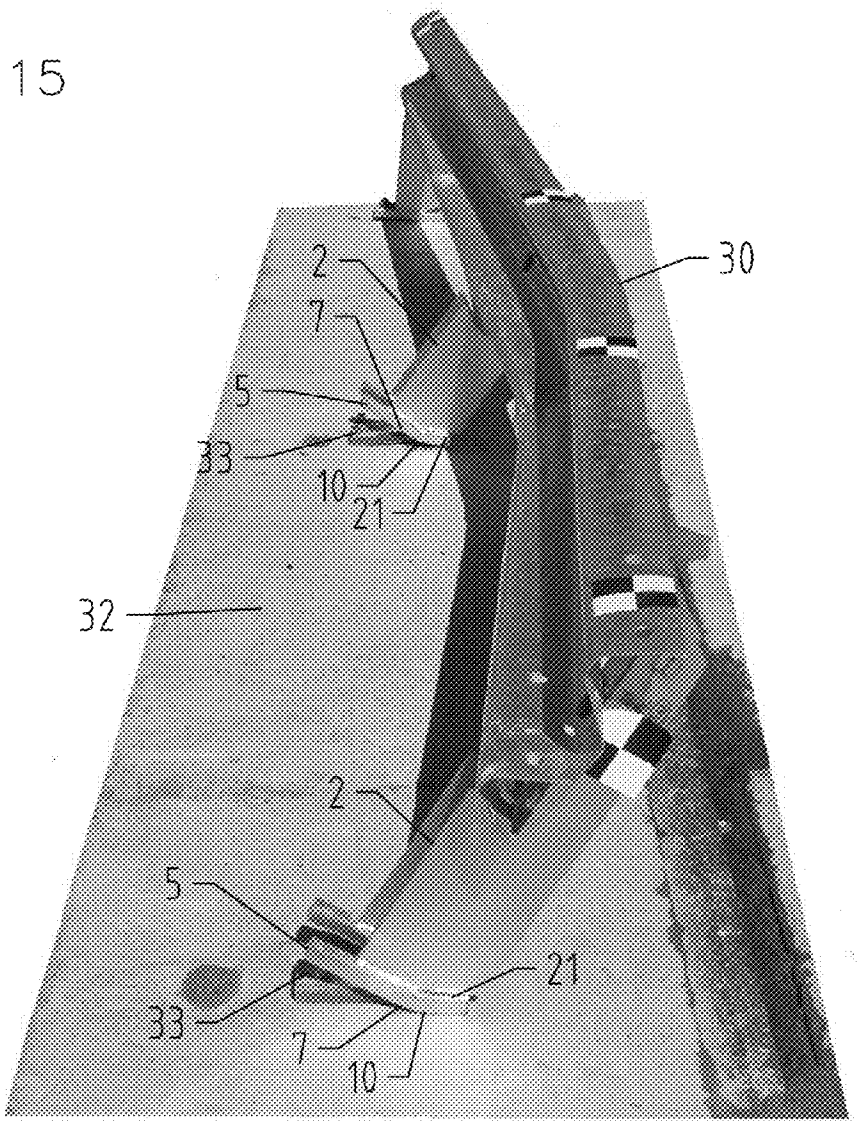
FIG. 15 is an image showing posts of the barrier system deformed about the respective footings.

In FIG. 15, the stop device 21 of each post 2 is clearly engaged to resist further deflection of the post 2. As such, the barrier system 30 allows for graduated impact absorption by way of the lever arms 5 plastically deforming about the hinge region 7, to dissipate a lot of the impact forces. Once the stop devices 21 are engaged, the response characteristics of the post assemblies 1 are changed dramatically and the system provides increased resistance to bending. This increased resistance serves to contain the remainder of the impact forces, when those forces are at a level that can be easily accommodated by the fastening bolts 33 without danger of the bolts 33 being pulled out of the support surface 32.

As may be appreciated from the above, advantages of the present invention are realized through the design of the base plate 10 of the post assembly 1. The base plate 10 is designed to absorb the energy of an impact over time and to regulate the peak pull out force applied to the anchor bolt(s) 33.

The design of the base plate 10 substantially increases the amount of energy that the post 2 and/or barrier system 30 can absorb compared to a rigid base plated post system that has a similar base plate size/footprint. Moreover the barrier system 30 will absorb the energy of impact from a colliding vehicle with fewer anchor bolts than that required in a system comprising rigid base plated posts.

As described above, the base plate 10 is preferably designed with two elongated slots 8 that run from the front 11 of the plate 10 toward the back 12 of the plate 10 but stop short of running the full length of the plate 10. This essentially forms the plate 10 into a central base pad 4 and two lever arms 5. Alternatively, the base plate 10 may be formed with a central lever arm 5 and two base pads 4. Other configurations may also be adopted, as required.

Upon impact with the barrier system 30 load is transferred by the longitudinal rail elements 31 to the posts 2. The posts 2 are then designed to absorb the energy of the impact by first elastic deformation resulting from the lever arms 5 bending backwards followed by plastic deformation from further bending of the lever arms 5.

The plastic deformation of the system 30 reduces and regulates the peak pull out load transferred to the anchor bolt(s) 33. The capacity of the lever arms 5 and hinge region 7 to plastically deform under load and absorb impact forces can be regulated by, for example:

the length of the slots 8;

the width of the lever arms 5;

the thickness of the base plate 10;

the termination point of the post relative to the terminal ends 25 of the slots 8 (this can regulate the length of the plastic hinge region 7 established in the base plate 10 and therefore the amount of material that is yielding and therefore absorbing energy); and the type of material that the post 2 is manufactured from.

The post 2 may be any type or form. It can be flat plate, hollow section or open section. The rail element 31 can also be of any suitable form. The rail element can be a W-beam guardrail, a triple corrugated guardrail, a hollow section, an open section, an I-beam, etc.

Apart from regulating the transferred load to the anchor bolts 33 the plastic hinge region 7 allows the post 2 to maintain a relatively constant optimal design load during the course of an impact as the lever arms 5 bend backwards. The option to provide a notch 18 in the post 2 enables a rear side of the post to be aligned over the back 12 of the base plate 10. This means the post 2 can be positioned toward a back of the plate 10, which minimizes the amount of car park space taken up by the post assembly 1. As a possible alternative, the footing 3 of the base plate 10 might be attached to a side edge of a slab flooring, which would mean no car park space at all is taken up by the post assembly 1. In either case, as is apparent from the above, the post assembly design has the capability to not only absorb impact forces but to also provide a second purpose whereby it adds a step up in the load capacity of the post 2 when the lever arms 5 have bent back so far such that the notch 18 between the plate 10 and the back of the post 2 effectively closes. This results in the rear of the post 2 bearing down on the base plate 10 to maximise the stopping power of the assembly 1.

Another feature of the barrier system of the invention is that the rail element is positioned forwardly of the hinge region 7 and the lever arms 5 pivot upwardly around the hinge region 7 during impact. This has the advantage of lifting or maintaining the height of the rail element during initial impact. With a conventional rigid base plated post, the rail element would be knocked down if the post is pulled out of the ground or concrete slab on impact. The invention, on the other hand, maintains or increases the rail element height for a duration of the impact which improves the ability of the barrier system to better contain and arrest movement of vehicles.

LIST OF PARTS

1. Post assembly
2. Post
3. Footing
4. Base pad
5. Lever arm
7. Hinge region
8. Slot
10. Base plate
11. Front side
12. Rear side
13. Side member
14. Brace
15. Hole
16. Lower end
17. Impact side
18. Notch
19. Base
21. Stop device
22. Aperture
25. Terminal end
26. Guardrail
27. Fastener
28. Hollow section
29. Sides
30. Barrier system
31. Rail element
32. Support surface
33. Bolt
34. Vehicle

The invention claimed is:

1. A post assembly for absorbing impact from a vehicle including a post, a footing and a lever arm connecting the post to the footing at a hinge region, wherein:

the footing, lever arm and hinge region are formed from a common base plate, with the footing and lever arm being separated by an elongate slot that extends in a direction away from an impact side of the plate and terminates at the hinge region, located toward a rear side of the plate; and the footing includes at least one aperture located toward the impact side of the plate, to receive a corresponding fastener to anchor the post assembly to a support surface; whereby under an impact load, the hinge region plastically deforms and the lever arm and post deflect about the footing, away from the impact side of the plate.

2. The post assembly of claim 1, wherein the lever arm extends parallel to and adjacent the footing.

3. The post assembly of claim 2, wherein the post includes a side member attached to and aligned with lever arm.

4. The post assembly of claim 3, wherein the post includes two opposed side members connected to the lever arm.

5. The post assembly of claim 4, wherein the footing includes two base pads positioned either side of the lever arm, the base pads being separated from the lever arm by associated slots.

6. The post assembly of claim 3, wherein a second lever arm is provided on an opposite side of the footing, the second lever arm being separated from the footing by an associated slot and the post includes a second side member attached to the second lever arm.

7. The post assembly of claim 6, wherein the footing includes a single base pad positioned between the lever arms.

8. The post assembly of claim 1, including a stop device to restrict deflection of the post beyond a pre-determined position.

9. The post assembly of claim 8, wherein the stop device includes a notch in the post that closes as the post pivots under plastic deformation of the hinge region.

10. The post assembly of claim 9, wherein the notch is formed at a base of the post, to provide clearance between the post and the hinge region, so that the lever arm is free to pivot around the hinge region during deflection of the post away from the footing, until the notch closes against the hinge region.

11. The post assembly of claim 1, wherein the post is adapted to support a rail element in a position forwardly of the hinge region, with respect to a direction of impact of a vehicle or the like whereby pivotal movement of the post about the footing during impact causes the rail element to be lifted or maintained in height in order to contain and arrest movement of the vehicle.

12. The post assembly of claim 1, and a rail element supported between respective one or more posts of the assembly.

13. The post assembly of claim 12, wherein the rail element is mounted to one or more posts in a position forwardly of the associated hinge region, with respect to a direction of impact of a vehicle, whereby pivotal movement of the one or more posts about the footing during impact causes the rail element to be lifted or maintained in height to contain the vehicle.

* * * * *